US005172813A

United States Patent [19]

Ljokkoi

[11] Patent Number: 5,172,813

[45] Date of Patent: Dec. 22, 1992

[54] METHOD AND AN APPARATUS FOR TREATING FIBER SUSPENSION

[75] Inventor: Risto A. Ljokkoi, Karhula, Finland

[73] Assignee: A. Ahlstrom Corporation, Noormarkku, Finland

[21] Appl. No.: 804,534

[22] Filed: Dec. 11, 1991

Related U.S. Application Data

[63] Continuation of Ser. No. 524,752, May 17, 1990, abandoned.

[30] Foreign Application Priority Data

May 17, 1989 [FI] Finland ..... 892356

[51] Int. Cl.[5] ..... D21D 5/00; B07B 1/20

[52] U.S. Cl. ..... 209/270; 209/273; 209/380; 210/415

[58] Field of Search ..... 209/268, 270, 273, 305, 209/306, 379, 380; 210/413, 415; 162/55

[56] References Cited

U.S. PATENT DOCUMENTS

| | | | |
|---|---|---|---|
| 3,363,759 | 1/1968 | Clarke-Pounder | 209/273 |
| 3,409,132 | 11/1968 | Meadows | 209/273 |
| 3,437,204 | 4/1969 | Clarke-Pounder | 209/273 |
| 3,759,392 | 9/1973 | Syrganen | 209/273 X |
| 4,188,286 | 2/1980 | Holz | 209/273 |
| 4,193,865 | 3/1980 | Aario | 209/240 |
| 4,200,537 | 4/1980 | Lamort | 209/273 X |
| 4,202,761 | 5/1980 | Holz | 209/17 |
| 4,234,417 | 11/1980 | Gauld et al. | 209/273 X |
| 4,601,819 | 7/1986 | Pellhammer et al. | 209/273 |
| 4,676,903 | 6/1987 | Lampenius et al. | 210/413 |
| 4,832,832 | 5/1989 | Fujiwara et al. | 209/273 |
| 4,855,038 | 8/1989 | LeBlanc | 209/273 |
| 4,911,828 | 3/1990 | Musselmann et al. | 209/273 |
| 4,919,797 | 4/1990 | Chupka et al. | 209/273 |
| 5,000,842 | 3/1991 | Ljokkoi | 209/273 |

FOREIGN PATENT DOCUMENTS

| | | |
|---|---|---|
| 3006482 | 10/1981 | Fed. Rep. of Germany . |
| 56715 | 3/1980 | Finland . |

*Primary Examiner*—Donald T. Hajec

*Attorney, Agent, or Firm*—Nixon & Vanderhye

[57] ABSTRACT

A method and apparatus for treating a fiber suspension to thicken or screen it. The suspension is fed to the gap between a filter surface and a counter member, and accepts flow through openings in the filter surface. Rejects continue along the filter surface to a rejects outlet. Relative movement, preferably relative rotation, is effected between the filter surface and counter member. The suspension at the filter surface is coarser and/or of higher solids concentration than the accepts. This coarser suspension is subjected to a force component by a protrusion on the counter member surface that tends to move it away from the filter surface, in a guided manner (between the protrusion and a guide plate). A second protrusion in the form of a backwardly inclined plate forces fresh suspension toward the filter surface to take the place of the suspension just moved away from the surface.

21 Claims, 2 Drawing Sheets

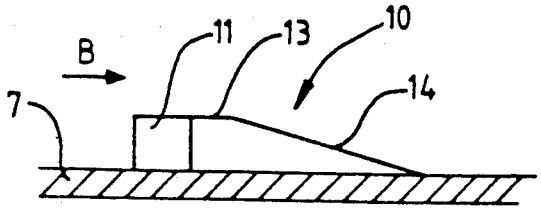
FIG. 2 *(PRIOR ART)*
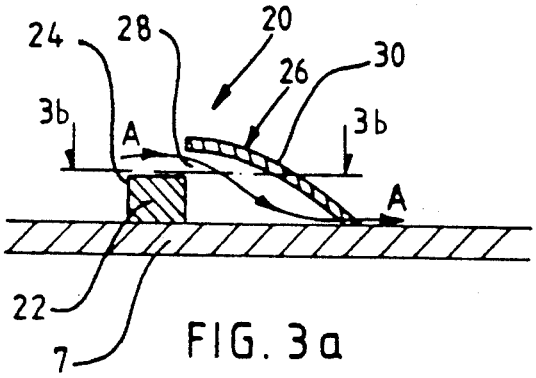
FIG. 3a
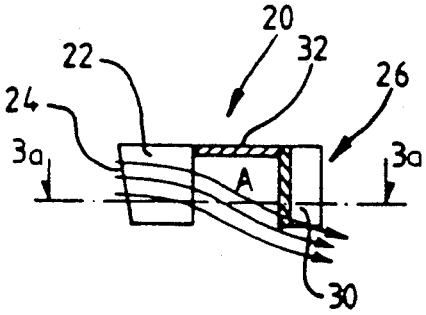
FIG. 3b
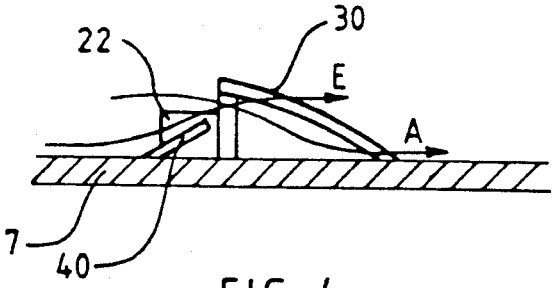
FIG. 4a
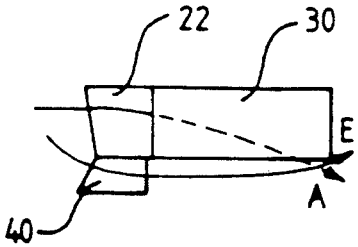
FIG. 4b
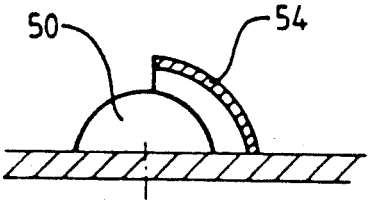
FIG. 5a
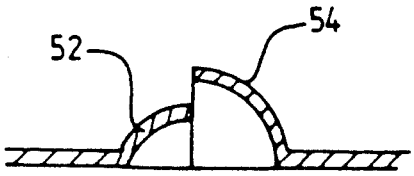
FIG. 5b
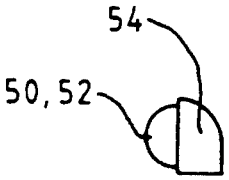
FIG. 5c

METHOD AND AN APPARATUS FOR TREATING FIBER SUSPENSION

This is a continuation of application Ser. No. 07/524,752, filed May 17, 1990, now abandoned.

BACKGROUND AND SUMMARY OF THE INVENTION

The present invention relates to a method and an apparatus for treating fiber suspension. The method in accordance with the invention is especially suitable for screening pulps of the pulp and paper industry and also for thickening. The apparatus part of the invention relates to a rotor construction of a power screen or a thickener.

There are, in principle, two commonly used types of rotor arrangements to maintain the filter surface clean, in other words to prevent the generation of a fiber matting on the filter surface. An example of one of these types is shown in U.S. Pat. No. 4,193,865. This discloses a rotor arrangement, in which a rotatable rotor is arranged inside a cylindrical, stationary filter cylinder. The rotor comprises blades located close to the surface of the filter cylinder, the blades forming an angle with the axis of the cylinder. The filter surface is subjected to pressure pulses when the blades move; the pressure pulses serving to open the cylinder openings. There are also arrangements in which the blades are located on both sides of the filter cylinder. In such a case the suspension being treated is introduced either to the inside or to the outside of the cylinder, and the discharge of the accepts takes place on the outside or the inside respectively.

An example of the second type of rotor is shown in U.S. Pat. No. 3,437,204. There the rotor is a substantially cylindrical, closed piece, the surface of which has almost hemispherical protrusions. The pulp in this type of apparatus is introduced to the treating space between the rotor cylinder and the filter cylinder outside the rotor cylinder, whereby the purpose of the rotor protrusions (bumps) is both to press the pulp against the filter cylinder and to draw the matted pulp with the trailing edge from the openings of the filter cylinder. Because this type of construction has a highly thickening effect on the pulp, three dilution water conduits are provided at different levels in the filter cylinder so as to satisfactorily carry out the screening of the fiber suspension. A corresponding "bump rotor" is disclosed also in U.S. Pat. No. 3,363,759, in which the rotor is slightly conical. Various forms of protrusions may be utilized.

German application 3006482 discloses a knotter, which has on the surface of a cylindrical rotor drum plough-shaped protrusions made of plate material, the purpose of which is to create strong mixing forces in the pulp between the rotor and the filter cylinder so that the fibers penetrate the filter cylinder as effectively as possible, and the knots, chips and the like are separated.

U.S. Pat. Nos. 4,188,286 and 4,202,761 illustrate a filter apparatus, which has a rotatable cylindrical rotor inside the filter cylinder. protrusions are arranged on the rotor surface on the filter cylinder side, and the protrusions shaped in such a way that one rotational edge has an evenly rising front surface, a surface parallel to the rim of the rotor and a back surface substantially perpendicular against the rotor surface. These protrusions are arranged on the surface of the rotor cylinder in a particular angle position relative to the axial direction so that all the protrusions of the rotor are at a similar position relative to the axis of the rotor. According to these US patents, pulp can be introduced into this apparatus at either side of the filter cylinder. If pulp is introduced to the outside of the filter cylinder and the accepts are discharged from the inside of the filter cylinder, the rotational direction of the rotor is such that the accepts are subjected to a downwardly inclined force component by the angle position of the protrusions and that said inclined/rising surface of the protrusions operates as a front surface. If the pulp is introduced between the rotor and the filter cylinder, in other words the accepts are discharged from the outside of the filter cylinder, the rotational direction is opposite to that previously described, the protrusions tending to slow down the downwardly flowing pulp, and the surface which is perpendicular relative to the surface of the rotor cylinder operates as the front surface.

Practical industrial experiments have, however, proven that the above described apparatus does not operate satisfactorily in all application conditions. For example, the first mentioned blade rotor creates pressure pulses at the accept side of the filter cylinder that are too strong, and is not therefore suitable, for example, in head boxes of paper machines where any fluctuation of pressure is undesirable. The apparatus also tends to dilute the accepts, and therefore the blade rotor is not applicable in apparatus, which require pulp of a constant consistency. Since the blades, (4 to 8 blades) in the blade rotor are spaced relatively far from each other, a fiber matting always accumulates on the surface of the filter cylinder before the next blade scrapes it off. Thus the use of the filter is not effective. Additionally, this rotor type is expensive to manufacture due to accurate shapes of the blades and a careful finishing.

A substantially cylindrical rotor, which has almost hemispherical protrusions, operates almost ideally in some applications, but, for example, in the head box of a paper machine its operation can be provided only with additional preconditions. Because the pulp suspension flowing to the head box should be homogeneous, both in consistency and in fiber size, the power screen should not vary these values. However, this kind of a "bump rotor" tends to dilute the accepts, and it causes fluctuation in the consistency values. In experiments it was discovered that a rotor of this type diluted accepts between $-0.15$ to $-0.45\%$ when the accept consistency was 3%. Consequently, the consistency varies absolutely $\pm 5\%$, which is too much when a homogeneous and qualified final product is desired. Fractionation also takes place in the screen comprising a "bump rotor", in other words the mutual relation between the fractions of the fiber suspension supplied to the filter cylinder changes in the screen in such a way that the relation of the fractions of the accepts is no longer the same as that of the originally supplied pulp. With a "bump rotor" the extent of change of said fractionation was experimentally found to be between 5 to 10% according to the clearance of the filter cylinder and the rotor. The corresponding extent of change with a blade rotor was about 20, and therefore even a "bump rotor" is a considerable improvement to the previous apparatuses.

These defects of a filter apparatus provided with a "bump rotor" described above have led to some improvement attempts, such as guidance of the dilution water to the filter surface, and in a slightly conical shape of the rotor. Both alternatives reflect the problem occurring in communication with the cylindrical rotor, i.e.

the uneveness in the use of a filter cylinder in its different zones. The fact is that the flow through the filter cylinder is at its greatest immediately after pulp has come into communication with the cylinder and the rotor. Consequently the pulp thickens to some extent and when the pulp flows downwardly along the surface of the filter cylinder, the amount of the suspension flowing through the filter openings continuously diminishes. Attempts have been made to prevent this by feeding dilution water to different levels of the filter surface, which results in a slightly more effective operation of the filter cylinder, but which also results in the disadvantage of a relatively high dilution of the accepts. Another possibility is to vary the clearance between a filter cylinder and a rotor, whereby a greater clearance in the upper part of the filter apparatus enables a higher speed of the downwardly flowing pulp, so that the pulp fills the clearance better and more homogeneously.

An operating method is disclosed in the U.S. Pat. No. 4,188,286, in which the protrusions are inclined relative to the axis of the filter cylinder. The main purpose of the inclination is to prevent the fiber or fiber flocs from attaching to the front edge of the protrusion and from being conveyed with it. A secondary purpose is to bring the accept pulp in the treatment space between the rotor and the filter cylinder subject to a downward force component, by which it is possible to accelerate to some extent the operation of a filter apparatus, at least to accelerate the discharge of the accept from the filter.

The most developed embodiment in the market at the moment is illustrated by the method in accordance with FI patent 77279, and by the apparatus developed to realize this method. The method in accordance with this Finnish patent is characterized in that fiber suspension is subjected to axial forces, the intensity and the direction of which vary according to the mutual axial position between the point of application and the counter surface of the filter cylinder, and which are utilized to change the axial speed profile of the fiber suspension while maintaining the direction of the flow continuously towards the discharge end. The apparatus thereof is characterized in that at least one of the counter surfaces of the filter cylinder has at least one bump or the like, the direction of the front surface to which varies according to the axial position of the bump and by which the pulp particles in the space between the counter surfaces, i.e., the filter cylinder and rotor, are subjected to an axial force component, the intensity of which varies in function of the axial position of the pulp particles, and which changes the speed profile of the fiber suspension flowing between the counter surfaces.

Although the arrangement and the method in accordance with Finnish 72279 are superior to the prior art techniques, it is still possible to further develop the method and apparatus described therein. Minute experiments have shown that all rotors, which use any kind of protrusions (whether bladelike, hemispherical, rectangular or any other type),have associated therewith—beginning from the peak of said protrusion towards the trailing direction—pulp whose consistency and reject content is higher than in the screening zone. This is due to the fact that the pressure stroke caused on the pulp by the bump has pressed acceptable material through the filter surface, whereby both liquid and acceptable fiber material flows through the screen surface.

It has also been discovered in such experiments that said pulp which has a higher consistency and which contains more rejectable material tends to remain against the screen surface regardless of the fact that the effect of the bump on the rotor on said pulp. portion stops. This, of course, weakens the capacity of the screener, because fresh or less screened pulp must first penetrate the layer of a higher consistency in order to pass the filter. In thickeners, the fiber matting accumulated on the filter surface causes a situation to exist whereby in order for the filtrate to pass the opening of the filter surface it must also be pressed through the fiber matting.

The present invention relates to a method and apparatus for conveying the above mentioned thicker and coarser pulp portion from the filter surface towards the surface of the rotor so that the fresher pulp comes into direct communication with the filter surface, whereby the disadvantages of the prior art apparatus discussed above may be minimized or eliminated.

The method in accordance with the present invention is characterized in that the pulp fraction concentrated adjacent to the filter surface and/or containing coarser material is subjected to a force component directed away from the filter surface, by means of which that fraction is conveyed away from the filter surface.

An embodiment of the apparatus in accordance with the present invention is characterized in that at least one guide plate is arranged to communicate with the member counter to the filter surface, i.e., the rotor, which guide plate guides the coarser and/or thicker suspension concentrated adjacent to the counter member surface, away from the filter surface.

Another embodiment of the apparatus of the invention is characterized in that the counter surface to the filter surface has at least one member which is formed by a protrusion arranged on the counter surface, and a guide plate extends from the level of the counter surface higher than the protrusion. The protrusion and guide plate leave an opening therebetween, through which the thicker and/or coarser fraction can flow, under the guide plate.

The method and apparatus in accordance with the present invention are described more in detail below, by way of example, with reference to the accompanying drawings, in which:

BRIEF DESCRIPTION OF THE DRAWINGS

FIG. 2 is a schematic side view of a protrusion of a rotor described in the above mentioned FI patent of a prior art screen in accordance with FIG. 1;

FIGS. 3*a* and *b* are schematic illustrations of a protrusion of a rotor in accordance with a preferred embodiment of the present invention developed for the apparatus in accordance with FIG. 1; FIG. 3*a* is a section along the line 3*a*–3*a* of FIG. 3*b*, which is a section along the line 3*b*–3*b* of FIG. 3*a* and with the rotor surface omitted;

FIGS. 4*a* and *b* are schematic illustrations of an auxiliary apparatus for intensifying the operation of the protrusion in accordance with the invention arranged in communication with an embodiment in accordance with FIGS. 3*a* and 3*b*; and FIGS. 5*a* and *b* are schematic sectional illustrations of two protrusion arrangements in accordance with a second embodiment of the invention to replace the substantially spherical calotte shaped protrusions of a so called "bump" rotor, with FIG. 5*c* being a plan of the protrusions of FIGS. 5*a* and 5*b*, with the rotor surface omitted.

DETAILED DESCRIPTION OF THE DRAWINGS

Figure 1:
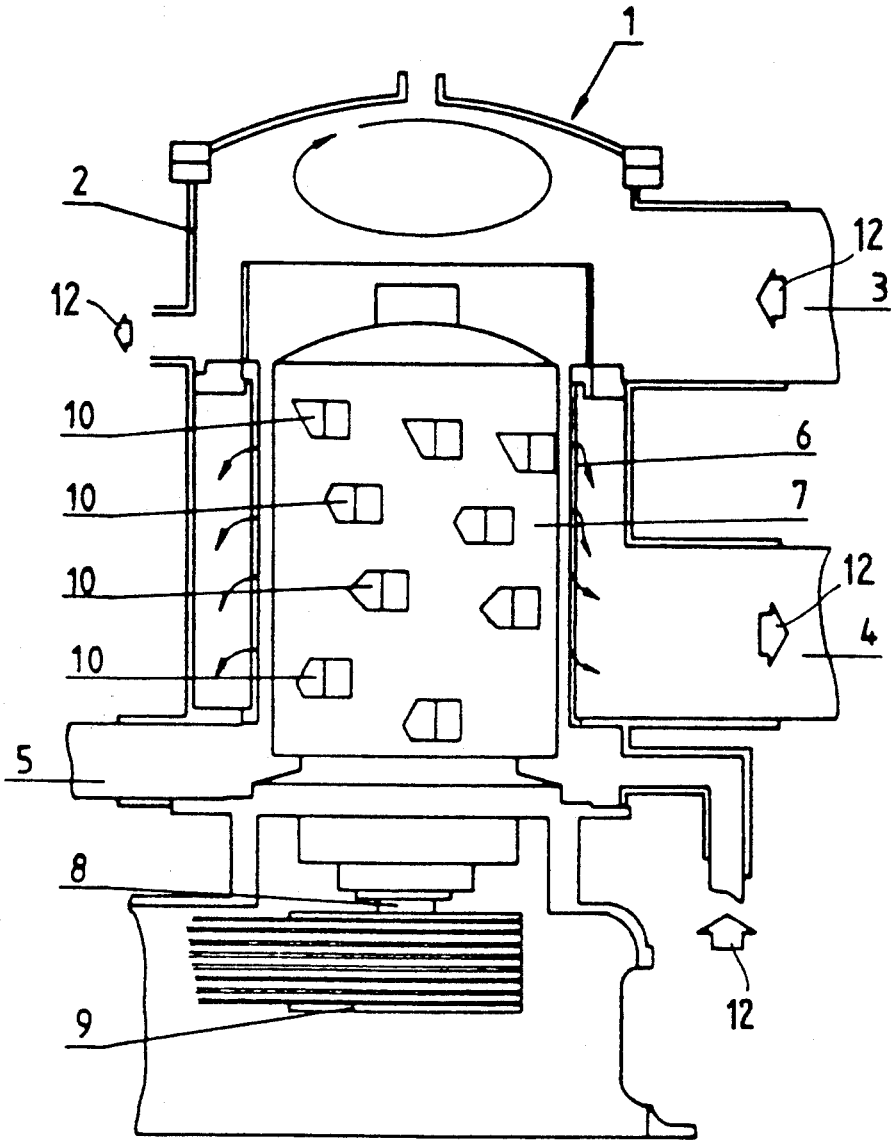
FIG. 1 (PRIOR ART)
FIG. 1 is a schematic illustration of a prior art screen device in accordance with FI Patent 77279.

According to FIG. 1 a filter apparatus 1 comprises the following members: an outer casing 2, conduit 3 for the inflowing pulp, conduits 4 and 5 for the accepts and the rejects respectively, and a stationary filter cylinder 6 having passageways or grooves allowing the egress of suspension as designated by flow arrows 12 and a substantially cylindrical or possibly conical rotor 7 therein having a shaft 8 with drive means 9. The filter cylinder 6 has an inner or first major surface and an outer or second major surface. The cylinder may, in principle, be of any previously known type, but the best results are achieved, if a contoured filter cylinder is used. Generally, the apparatus in accordance with FIG. 1 operates in such a way that the fiber suspension is introduced through conduit 3 and flows to the gap between the filter cylinder 6 and the rotor 7, to the so called "treatment" space. The accepts, which have flowed through the openings of the filter cylinder (when the apparatus 1 is a thickener, the filtrate corresponds to the accepts) is discharged through the conduit 4 up to the lower end of the gap between the filter cylinder 6 and the rotor 7. The pulp, which flows away from the gap, is discharged through the rejects conduit 5. FIG. 1 also teaches members 10 on the surface of the rotor 7, and that on the side facing the filter cylinder 6 the shape of the members 10 may vary, for example, in the way described in FI patent 77279, according to in which axial zone of the rotor they are located in.

FIG. 2 is a schematic illustration of a member 10, the front surface 11 of which may be either parallel to the direction of the axis of the cylinder, inclined to some direction relative to the axis or further divided into portions, the inclination of which portions relative to the axis may be chosen as desired. This kind of front surface 11, when moving relative to the pulp towards arrow B, subjects the pulp not only to a tangential force component, but also almost always to an axial force component which pumps pulp towards the center area of the cylinder and also always to a pressure stroke towards the filter surface, intensifying the pulp treatment, due to the effect of which the acceptable fiber material and liquid are pressed through the filter and a zone of coarser, to some extent thickened material is generated on the surface of the filter. The front surface 11 of a member 10, in accordance with an embodiment of FI patent 77279, is substantially perpendicular the surface of rotor 7. The front surface 11 may, of course, also be inclined in one or the other directions. The protrusion has a part 13 substantially parallel to the surface of rotor 7 and an inclined surface 14 descending from part 13 to the surface of the rotor 7. The pressure stroke, which intensifies screening and also thickening, is generated exactly at the front surface of the protrusion or slightly before it, and creates an underpressure zone on the inclined surface of the trailing side of the protrusion, which zone draws the coarser and thickened material away from the filter surface.

FIGS. 3*a* and 3*b* illustrate a protrusion arrangement 20 of the rotor in accordance with an embodiment of the present invention, in which arrangement a pressure pulse towards the filter surface is generated by a protrusion 22, which, in principle, may be of any shape. The significance of the protrusion arrangement 20 is that a member 26 has been arranged at the trailing side of the front surface 24 of the protrusion 22 which member extends closer to the inner surface of the filter 6 than the protrusion 22. Member 26 is further characterized by a gap 28 formed between the member 26 and the protrusion 22, through which the thicker and coarser pulp generated between the protrusion and the filter surface is allowed to pass (to the space between member 26 and the rotor surface). From gap 28 the courser pulp is further discharged to the area of the rotor surface, as arrows A in FIGS. 3*a* and 3*b* illustrate. Consequently, an underpressurized zone is generated between the member 26 and the filter surface 6, which zone is filled by fresher, less treated pulp. The member 26 is formed by a guide plate 30 made of bent plate material in the embodiment of the figure, which plate 30 forms an acute angle with the filter cylinder surface corresponds to the inclined trailing surface 14 of the member 10 in the arrangement illustrated in FIG. 2 creating a corresponding underpressure stroke on the filter surface, and by a plate 32 located on the flow inlet side of the protrusion 20 (most usually at the level of the upper surface of the protrusion when the rotor is vertically positioned). Plate 32 prevents the flow of the fiber material, which has passed under part 26 from flowing to the upstream side of the protrusion, and on the other hand, also the suspension flowing along the surface of the rotor from flowing under the guide plate 30.

The protrusions 20 are used in place of the protrusions 10 in the device of FIG. 1 in the practice of the invention.

FIG. 4 illustrates a protrusion 20 in accordance with FIG. 3, which communicates with a backwardly inclined plate 40 arranged to the downstream side of it. The purpose of the plate 40 is to guide the unscreened (or at least less screened) pulp which has flowed along the surface of the rotor, from under the part 26 to above the flowing pulp layer. In other words the objective is to replace the thickened pulp (including rejects) flowing in the direction of arrow A by fresh pulp flowing from the filter surface adjacent to the rotor surface in the direction of arrow E.

FIGS. 5*a*, *b* and *c* illustrate how the pulp replacement in accordance with the invention may be realized when so called bump rotors in accordance with the prior art are used. As known, the bump is formed either by an exactly hemispherical or spherical calotte-shaped protrusion, which may either be a closed protrusion 50 (FIG. 5*a*) attached to the surface of the rotor, or in some cases possibly a protrusion 52 (FIG. 5*b*) pressed on the casing of the rotor from inside of the rotor. In that case a scraper 54 may of course be either a completely separate bent protrusion made of metal or like material (FIG. 5*a*), or a protrusion pressed more deeply from inside of the surface of the rotor (FIG. 5*b*), which protrusion is open substantially from the top and from the downstream side as illustrated in FIGS. 5*b* and 5*c*.

The operation corresponding to the previous embodiments may be created by a blade in such a way that both the outer and the inner surfaces of the blade are provided with guide plates arranged within certain distances from each other, which guide plates either (a) "cut" coarser fiber material, thickened adjacent to the filter surface, carry it into the blade and remove it on the trailing edge of the blade to the other side of the blade, or (b) guide in a corresponding way fresher, less treated suspension through the inner space of the blade to the filter surface. Naturally, the flow passages of the suspension inside the blade must be separated from each other with intermediate walls, which may be either perpendicular to the blade surfaces or at a suitably chosen angle relative thereto. The guide plates are further characterized in that they are located intermittently relative to each other on the opposite surfaces of the blade.

The invention may be practiced with suspensions having a wide range of consistencies, however for a suspension consistency of about 0.5–2.5% solids the invention is particularly useful.

An alternative to the above described arrangement is to arrange the guide plates above the blade surface with intermediate members in such a way that the flow of the desired pulp fraction takes place from between the blade and the guide plate. By varying the location of these guide plates or the guide plates mentioned in the previous alternative to different parts of the blade, the pulp replacement process described with respect to the previous embodiments is carried out.

A rotor provided with the protrusion or blade construction in accordance with the invention is applicable to be utilized both with smooth and grooved filter cylinders, so the filter cylinder may be either completely smooth or grooved in different ways, as described in FI-patent 77279.

Thus by utilizing these arrangements in accordance with the invention new rotors may be applied in older type of filter cylinders and vice versa. This results in a filter cylinder-rotor combination operating better than the previous screening and thickening arrangements.

The rotor arrangement in accordance with the invention was tested in experiments in which different filter cylinders and different rotors were compared with each other. The filter cylinders used in the experiments were both smooth cylinders and cylinders made of different plate contours. The test results showed that the apparatus in accordance with the invention operates with all filter cylinders more effectively than the other rotors. The most preferred filter embodiment according to these tests was a filter cylinder having grooves which were formed substantially by the bottom surface parallel to the cylinder casing, and the inclined side surface on the upstream side (the inflow direction of the flow) relative to the bottom surface and the side surface substantially perpendicular against the casing surface of the cylinder on the downstream side relative to the bottom surface.

As is clear from the above description, the method and apparatus in accordance with the invention allow the elimination or minimization of the defects of the methods and apparatuses of the prior art and at the same time it is possible to gain a considerable increase in the maximum capacity of the apparatus.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of treating a fiber suspension utilizing a filter apparatus including a filter surface having openings therein, a counter member having an axially and circumferentially extending counter surface provided with protrusions, each of which has an axial length less than the axial length of said counter surface, said counter member cooperating with the filter surface to define a gap therebetween, said filter surface further including a discharge end and an inlet end, with an accepts volume provided on the opposite side of the filter surface from the gap, the method comprising the steps of:

(a) under force, drawing the suspension into the gap between the filter surface and the counter member at the inlet end of the filter surface;

(b) effecting relative movement between the filter surface and the counter member, so that relatively fine accepts pass through the openings in the filter surface and relatively coarse rejects pass toward the discharge end, some suspension at the filter surface being coarser and/or of higher solids concentration than the accepts; and (c) during the practice of step (b), diverting the suspension at the filter surface of coarser and/or higher solids concentration than the accepts away from the filter surface and physically moving the coarser and/or higher solids concentration suspension to the rotor surface by means of said protrusions, thereby causing new fiber suspension to be fed towards the filter surface to replace the coarser and/or higher solids concentration suspension.

2. A method as recited in claim 1 wherein step (b) is practiced by rotating at least one of the filter surface and counter member with respect to the other.

3. A method as recited in claim 1 wherein steps (a)–(c) are practiced with the suspension at a solids consistency of about 0.5–2.5%.

4. Apparatus for treating suspension, comprising:

(a) a filter surface having openings therein, an inlet end and an outlet end, and first and second major surfaces;

(b) a counter member having an axially and circumferentially extending counter surface;

(c) means for mounting the counter member and filter surface so that there is a gap between them at the first major surface of the filter surface;

(d) means for effecting relative movement between the filter surface and the counter member;

(e) means for introducing suspension into the gap, at the inlet end;

(f) means for withdrawing suspension passing through the filter surface openings away from the second major surface of the filter surface;

(g) means for withdrawing suspension not passing through the filter surface openings from the discharge end; and (h) plural means arranged on said counter surface and having an axial dimension less than the axial length of the counter member for subjecting some thicker and coarser suspension in the gap at said first major surface of said filter surface to a force component that diverts said thicker and coarser suspension away from the first major surface of the filter surface and physically moves said thicker and coarser suspension to the counter surface.

5. Apparatus as recited in claim 4 further comprising (i) means for subjecting some suspension in the gap and not at the filter surface to a force component that moves that suspension toward the filter surface first major surface to replace the suspension moved away from the filter surface first major surface.

6. Apparatus as recited in claim 5 wherein said means (h) and (i) comprise a plurality of first and second protrusions, respectively, extending from said counter surface toward said filter surface.

7. Apparatus as recited in claim 6 wherein said means (h) further comprises guide plates associated with said first protrusions and each extending outwardly from said counter surface toward said filter surface a greater extent than a said corresponding first protrusion, to define an opening between each said guide plate and a said first protrusion, said opening being dimensioned to allow thicker and or coarser suspension than the accepts to flow therethrough.

8. Apparatus as recited in claim 7 wherein said filter surface is cylindrical and said counter surface is cylindrical, substantially concentric with said filter surface; and wherein said means (c) and (d) comprise means for mounting said counter surface for rotation with respect to said filter surface and for effecting relative rotation therebetween, said gap being a radial gap, having an annular shape in cross section.

9. Apparatus as recited in claim 8 wherein said guide plate is on the trailing side of the first protrusion with which it is associated in the direction of rotation, and forms an acute angle with the counter surface, opening toward said first protrusion.

10. Apparatus as recited in claim 9 wherein said second protrusions comprise backwardly, in the direction of rotation of said counter surface, inclined plates.

11. Apparatus as recited in claim 4 wherein said means (h) comprise a plurality of first protrusions, extending from said counter surface toward said filter surface.

12. Apparatus as recited in claim 11 wherein said means (h) further comprises guide plates associated with said first protrusions and each extending outwardly from said counter surface toward said filter surface a greater extent than a said corresponding first protrusion, to define an opening between each said guide plate and a said protrusion, said opening being dimensioned to allow thicker and or coarser suspension than the accepts to flow therethrough.

13. Apparatus as recited in claim 12 wherein said filter surface is cylindrical and said counter surface is cylindrical, substantially concentric with said filter surface; and wherein said means (c) and (d) comprise means for mounting said counter surface for rotation with respect to said filter surface and for effecting relative radial movement between each other, said gap being a radial gap, having an annular shape in cross section.

14. Apparatus as recited in claim 13 wherein said guide plate is on the trailing side of the first protrusion with which it is associated in the direction of rotation, and forms an acute angle with the counter surface, opening toward said first protrusion.

15. Apparatus as recited in claim 4 wherein said filter surface is cylindrical and said counter surface is cylindrical, substantially concentric with said filter surface; and wherein said means (c) and (d) comprise means for mounting said counter surface for rotation with respect to said filter surface, and effecting rotation therebetween, said gap being a radial gap, having an annular shape in cross section.

16. Apparatus as recited in claim 15 wherein said means (i) comprises a plurality of second protrusions extending from said counter surface toward said filter surface, said second protrusions comprising backwardly, in the direction of rotation, inclined plates.

17. Apparatus as recited in claim 4 wherein said filter surface comprises a filter cylinder having grooves formed therein by at least two inclined or curved side surfaces.

18. A counter member for an apparatus for treating suspension, adapted to cooperate with a filter surface, said counter member comprising:

a cylinder having an exterior surface;

means for mounting said cylinder for rotation about an axis;

a plurality of first protrusions extending radially outwardly from said cylinder a predetermined distance; and guide plates axially adjacent to each of said first protrusions and each extending radially outwardly from said counter surface toward said filter surface a greater extent than a said corresponding first protrusion, to define an opening between each of said guide plates and an adjacent one of said first protrusions, whereby the suspension is drawn under force through said opening and under said guide plate so as to direct the suspension towards said cylinder exterior surface.

19. A counter member for an apparatus for treating suspension, adapted to cooperate with a filter surface, said counter member comprising:

a cylinder having an exterior surface;

means for mounting said cylinder for rotation about an axis;

a plurality of first protrusions extending radially outwardly from said cylinder a predetermined distance; and guide plates adjacent to said first protrusions and each extending radially outwardly from said counter surface toward said filter surface a greater extent than a said corresponding first protrusion, to define an opening between each of said guide plate and a said protrusion, whereby the suspension is drawn under force through said opening and under said guide plate so as to direct the suspension towards said cylinder exterior surface; and wherein each said guide plate is on the trailing side, in the intended direction of rotation of said cylinder, of the first protrusion with which it is associated, and forms an acute angle with the cylinder surface, opening toward said first protrusion.

20. A counter member as recited in claim 19 further comprising a plurality of second protrusions extending radially outwardly from said cylinder surface.

21. A counter member as recited in claim 20 wherein said second protrusions comprise backwardly, in the intended direction of rotation of said cylinder, inclined plates.

* * * * *